United States Patent [19]

Barril

[11] 4,119,286

[45] Oct. 10, 1978

[54] FURNITURE FRAMES

[76] Inventor: Claude Barril, 17 Rue Baron, 75017 Paris, France

[21] Appl. No.: 782,076

[22] Filed: Mar. 28, 1977

[51] Int. Cl.[2] ..... F16M 11/16; A47C 7/00

[52] U.S. Cl. ..... 248/188; 248/188.1; 297/440; 297/445; 403/347

[58] Field of Search ..... 248/188, 188.1; 297/440, 445; 403/175, 234, 237, 347, 349

[56] References Cited

U.S. PATENT DOCUMENTS

| | | | |
|---|---|---|---|
| 3,103,742 | 9/1963 | Cruson | 248/188.1 UX |
| 3,719,389 | 3/1973 | Burton et al. | 297/440 |

FOREIGN PATENT DOCUMENTS

| | | | |
|---|---|---|---|
| 945,827 | 5/1949 | France | 297/440 |
| 292,665 | 6/1928 | United Kingdom | 248/188 |

*Primary Examiner*—James C. Mitchell

*Attorney, Agent, or Firm*—Brisebois & Kruger

[57] ABSTRACT

A furniture frame including an assembly of tubular components of thermoplastic material in which the connections between the components are constituted by part of one component in the shape of a flattened bend, passed through by a second tubular component and elastically gripping the second component, there being an annular groove formed in the interior of the flattened bend, in which can engage at least two studs which project from the opposed surface of the second tubular component.

4 Claims, 3 Drawing Figures

FURNITURE FRAMES

The present invention has as its subject furniture frames, suitable for pieces of outdoor furniture, particularly garden chairs or tables.

The invention relates more particularly to furniture frames of the kind including an assembly of tubular components of thermoplastic material in which the connections between the components are constituted by a part of one component in the shape of a flattened bend, passed through by a second tubular component and elastically gripping the second component. Once the frame has been put together, by assembly of its different tubular components, the latter are secured together by fixing the bends above-mentioned by adhesive to the tubes which pass through them.

This method of fixing has the invconvenience of practically preventing any subsequent disassembly of the frame. Moreover, it increases the time necessary for assembly of the frame, which increases the cost of the latter.

The object of the invention is to cure these inconveniences by producing furniture frames in which the tubular components can be firmly assembled together while being easily disassembled.

According to the present invention there is an annular groove formed in the interior of the flattened bend, in which can engage at least two studs which project from the opposed surface of the second tubular component.

To bring about the assembly between two tubular components, of which one has an angle constituted by the flattened bend above-mentioned, it is sufficient to separate resiliently the two limbs of the bend and to introduce the second component into the bend until the studs are engaged in the groove of the bend. One thereupon permits the two limbs of the bend to close together around the second component, which ensures a firm connection between the two components in question.

Other features and advantages of the invention will appear in the course of the detailed description which will follow.

In the accompanying drawings, there has been shown one embodiment of the invention, given by way of non-limiting example. In these drawings.

Figure 1:
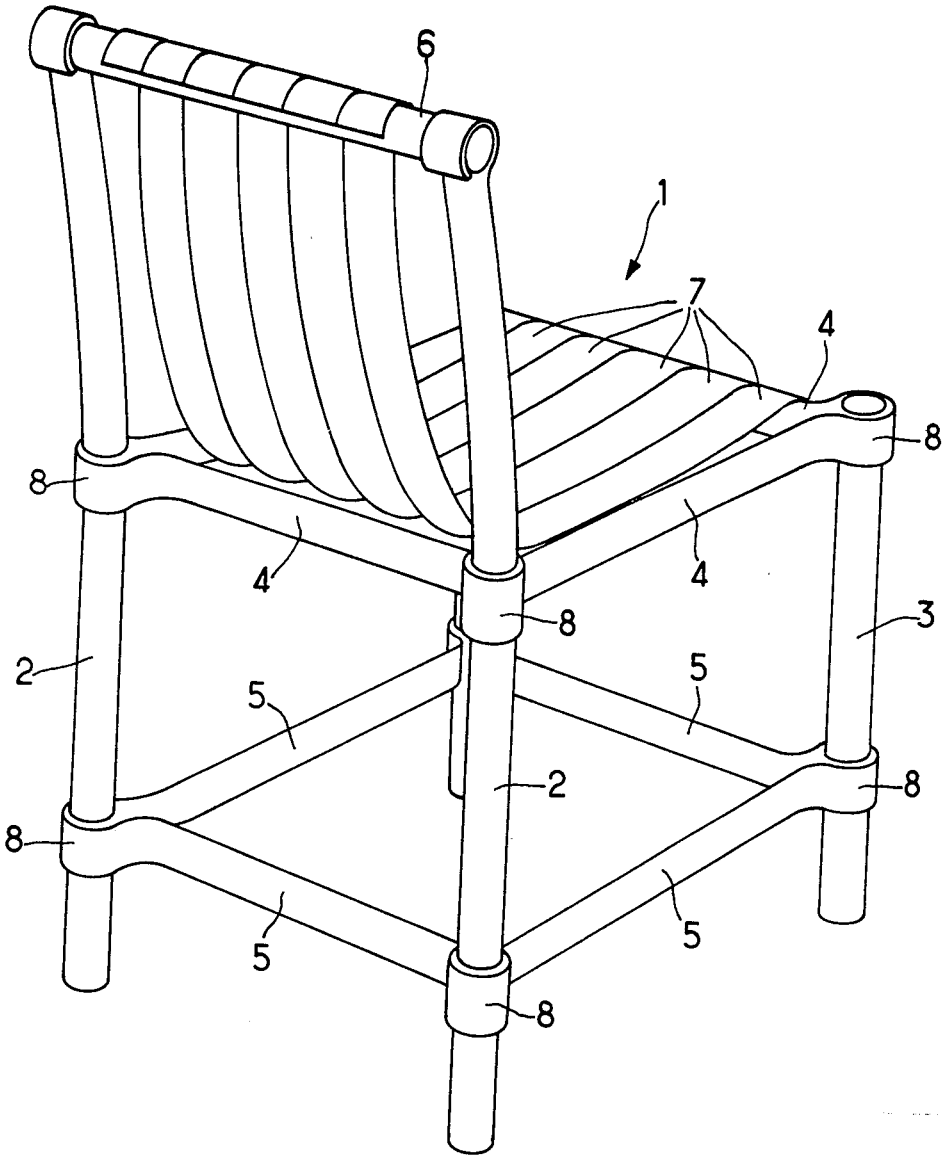
FIG. 1 is a perspective view of a garden chair.

The piece of outdoor furniture shown in FIG. 1 is a chair 1, having a frame constituted by an assembly of tubular cylindrical components 2, 3, 4, 5, 6 made in thermoplastic material in a manner known per se. These components support adjacent straps 7, the ends of which are on the one hand wound round an intermediate horizontal cross bar 4 and on the other hand around the upper cross bar 6 of the chair, these straps thus giving the user the necessary support for sitting. The frame of the chair includes, in addition to the horizontal cross bars 4 and 6 above-mentioned, substantially vertical front uprights 3, rear uprights 2, and lower cross bars 5 which connect together the uprights 2 and 3. The connection between two tubular components of the chair, such as an intermediate cross bar 4 and an upright 2, is provided by a part of the cross bar 4 in the form of a flattened bend 8 passed through by the tubular upright 2 which it grips elastically. Connections of this kind are thus provided between the uprights 2 and 3 on the one hand and units of cross bars 4 and 5 on the other hand.

Figure 2:
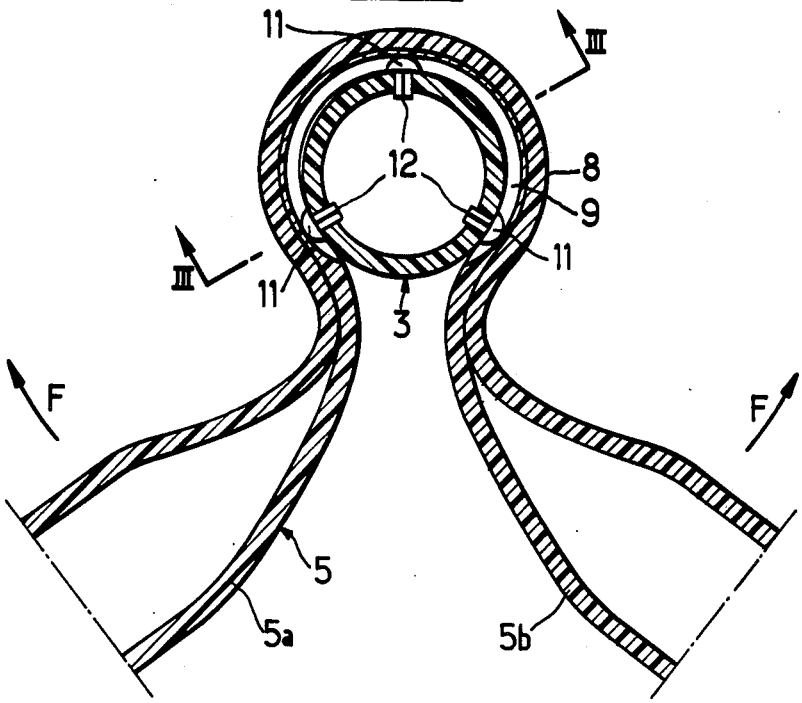
FIG. 2 is a transverse section on enlarged scale showing the fixing together of two tubular components of the chair shown in FIG. 1.
Figure 3:
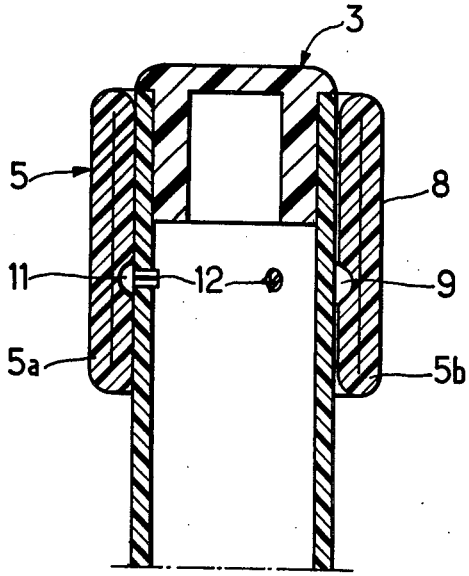
FIG. 3 is a longitudinal section along the line III—III in FIG. 2.

The chair 1 likewise includes means for fixing together the two tubular components in a connection. These means comprise an annular groove 9 (FIGS. 2 and 3) formed in the interior of the flattened bend 8 into which can engage three studs 11. Each stud has a hemispherical head, fixed to a body 12 of cruciform cross section embedded in the wall of the tubular component, constituted in the example given by an upright 3. The three studs 11 are distributed around the periphery of the component 3 with angular intervals between them of about 120°.

The bend 8 is made, in a manner known per se, by flattening of the tubular component under consideration, in the region where the latter forms an angle.

Once the studs 11 have been secured on a tubular component 3 by embedding of their bodies 12 in corresponding openings made in the component 3, it is sufficient to separate resiliently the two limbs of the bend by exerting forces on adjacent parts, 5*a*, 5*b* of the tubular component 5 in the senses indicated by the arrows F, then to introduce the end of the cylindrical upright 3 into the interior of the bend 8 until the studs 11 are engaged in the groove 9. A firm connection between the tubular components 5 and 3 is then achieved by permitting the limbs of the bend to close together resiliently around the upright 3, so that the bend firmly grips the studs 11 of the upright 3. This firmly fixes the upright 3 in the axial direction relatively to the unit of cross bars 5, while permitting rotation under frictional restraint of the upright 3 relative to the cross bars 5, thanks to the studs 11 which can slide rotationally in the groove 9.

Once the studs have been secured on the different tubular components constituting the furniture frame, the assembly and fixing relatively to each other of the total assembly of the tubular components is rendered very simple and very convenient, because one avoids a long adhesion operation. Moreover, the furniture frame thus assembled can be easily taken apart by separating the limbs of the bends, so as to be able to extract from them the associated tubular components.

The invention is not limited to the embodiment described and may include variations in the way it is carried out. One can for example vary the number of fixing studs 11, but in any case this number should not in principle be less than two, in order to permit firm assembly of the two components. One can likewise replace the studs 11 by any other appropriate means capable of engaging rotationally with friction in the retaining groove 9.

The invention is applicable to numerous kinds of pieces of outdoor furniture or chairs such as armchairs, chairs, stools, tables, chaise-lounge, etc.; of course these "outdoor" pieces of furniture may also be used inside dwellings, or on balconies or terraces without going outside the scope of the invention.

What I claim is:

1. A furniture frame comprising first and second tubular frame components, and joint means for securing said components together and comprising a joint portion of said first component, and a joint portion of said second component, said joint portion of said first component comprising a tubular exterior surface and at least two studs secured to said first component, each stud having a head projecting outwardly from said surface, said studs being coplanar and spaced from each other circumferentially of said exterior surface, said joint portion of said second component being integral with said second component and comprising a flattened portion located between two straight portions thereof extending at an angle to each other, said flattened portion extending around and exerting a resilient clamping action on said tubular exterior surface of said first component, said flattened portion having an annular groove in its interior surface extending circumferentially of the first component;

said stud heads each extending into said groove to lock said components and prevent longitudinal separation of said first component from said second component, whereby, spreading said straight portions apart simultaneously unclamps and unlocks said second component from said first component for insertion and removal of the first component, and releasing said straight portions with the first component positioned in the flattened portion of the second component locks the components together.

2. A furniture frame according to claim 1, in which each stud has a hemispherical head fixed to a body embedded in the wall of the first tubular component, and said groove has a cross-section corresponding to the heads of the studs.

3. A furniture frame according to claim 2, in which there are three of the studs, with intervals between them of substantially 120°.

4. An article of furniture having a frame including a plurality of the joints means defined in claim 1.

* * * * *